US008348387B2

(12) United States Patent
Albahri

(10) Patent No.: US 8,348,387 B2
(45) Date of Patent: Jan. 8, 2013

(54) PAGEWIDTH INKJET PRINTER WITH MULTIPLE ALIGNED PRINT HEADS

(75) Inventor: Tareq Abduljalil Albahri, Jaber Al-Ali (KW)

(73) Assignee: Kuwait University, Safat (KW)

( * ) Notice: Subject to any disclaimer, the term of this patent is extended or adjusted under 35 U.S.C. 154(b) by 197 days.

(21) Appl. No.: 12/897,666

(22) Filed: Oct. 4, 2010

(65) Prior Publication Data

US 2011/0018932 A1 Jan. 27, 2011

Related U.S. Application Data

(63) Continuation-in-part of application No. 11/944,737, filed on Nov. 26, 2007, now abandoned.

(51) Int. Cl.
*B41J 2/155* (2006.01)

(52) U.S. Cl. ..... 347/42; 347/86; 347/40

(58) Field of Classification Search ..... 347/9, 12–13, 347/20, 40, 42–44, 47
See application file for complete search history.

(56) References Cited

U.S. PATENT DOCUMENTS

| | | | | |
|---|---|---|---|---|
| 6,443,555 | B1 | 9/2002 | Silverbrook et al. | |
| 6,450,605 | B1 | 9/2002 | Walmsley et al. | |
| 6,629,744 | B2 | 10/2003 | Otsuki | |
| 6,637,860 | B1 * | 10/2003 | Madeley | 347/42 |
| 6,672,717 | B2 | 1/2004 | Smith | |
| 7,264,324 | B2 | 9/2007 | Kovacs | |
| 7,350,899 | B2 | 4/2008 | Kiguchi et al. | |
| 7,735,948 | B2 | 6/2010 | Walmsley et al. | |
| 2003/0214554 | A1 | 11/2003 | Tschida | |

* cited by examiner

*Primary Examiner* — Juanita D Jackson
(74) *Attorney, Agent, or Firm* — Richard C. Litman

(57) ABSTRACT

The pagewidth inkjet printer provides for simultaneous printing across a horizontal portion of a sheet of paper, as opposed to horizontal scanning of a conventional inkjet printer. The pagewidth inkjet printer includes a platen for incrementally translating a page of paper and a controller for selectively driving rotation of the platen. A housing is mounted adjacent to the platen and is fixed with respect thereto. A plurality of print heads are mounted within the housing. Each print head has a plurality of nozzles for selectively ejecting ink, and each nozzle is adapted for ejecting a distinct color of ink. The plurality of nozzles of each print head are aligned in a direction parallel to a direction of translation of the page of paper. The plurality of print heads are arrayed and aligned linearly along a direction orthogonal to the direction of translation of the page of paper.

10 Claims, 6 Drawing Sheets

PAGEWIDTH INKJET PRINTER WITH MULTIPLE ALIGNED PRINT HEADS

CROSS-REFERENCE TO RELATED APPLICATION

This application is a continuation-in-part of U.S. patent application Ser. No. 11/944,737, filed on Nov. 26, 2007 now abandoned.

BACKGROUND OF THE INVENTION

1. Field of the Invention

The present invention relates to printing devices, and particularly to a pagewidth inkjet printer that provides for simultaneous printing across a horizontal portion of a sheet of paper, as opposed to the horizontal scanning of a conventional inkjet printer.

2. Description of the Related Art

Inkjet printers are well known in the art. FIG. 2 is a schematic structural diagram of a printing system equipped with a conventional prior art inkjet printer 20. The printer 20 is equipped with a main scan feeding mechanism that slides carriage 30 back and forth along sliding axis 34 using carriage motor 24, a sub-scan feeding mechanism that transports printing paper P in a direction perpendicular to the main scan direction (called "the sub-scan direction") using paper feed motor 22, a head driving mechanism that drives printing head unit 60, which is on carriage 30, and controls ink ejection and dot formation, and control circuit 40, which exchanges the control signals with these paper feed motor 22, carriage motor 24, printing head unit 60, and operating panel 32. Control circuit 40 is connected to computer 88 via connector 56.

The main scanning mechanism for reciprocating the carriage 30 includes a sliding shaft 34 mounted on the platen 26 and designed to slidably support the carriage 30, a pulley 38 for extending an endless drive belt 36 between the carriage 30 and the carriage motor 24, and a position sensor 39 for sensing the origin position of the carriage 30. Typically, the sub-scanning mechanism for transporting the printing paper P is provided with a gear train (not shown) for transmitting the rotation of the paper feed motor 22 to a paper feed roller (not shown). The paper feed roller transports the printing paper in the direction perpendicular to the sliding direction of the carriage 30.

FIG. 4 is a block diagram illustrating the structure of prior art inkjet printer 20 with control circuit 40 as its core. Control circuit 40 is formed as an arithmetic logical operation circuit having a CPU 41, programmable ROM (PROM) 43, RAM 44, and a character generator (CG) 45 that records the dot matrix of characters. This control circuit 40 further includes a dedicated interface circuit 50 that performs an interface exclusively with an external motor, a head drive circuit 52 that is connected to this dedicated interface circuit 50, drives the printing head unit 60, and ejects ink, and a motor drive circuit 54 that drives paper feed motor 22 and carriage motor 24. Dedicated interface circuit 50 has a built in parallel interface circuit, and can receive printing signal PS supplied from computer 88 via connector 56. By executing the computer program stored in PROM 42, CPU 41 functions as the color mode unit 41*a*, monochromatic mode unit 41*b* and position adjusting feed unit 41*c*. An upper-edge color mode is performed by the upper-edge unit 41*a*1 of the color mode unit 41*a*, whereas the routine color mode is performed by a routine unit 41*a*2. Color mode printing based on routine feeding is performed with the aid of the routine unit 41*a*2 of the color mode unit 41*a*, whereas color mode printing based on minor feeding is performed by a lower-edge unit 41*a*3. Similarly, upper-edge monochromatic mode printing is performed by the upper-edge unit 41*b*1 of the monochromatic mode unit 41*b*, whereas routine monochromatic mode printing is performed by a routine unit 41*b*2. The monochromatic mode printing based on routine feeding is performed with the aid of the routine unit 41*b*2 of the monochromatic mode unit 41*b*, whereas the monochromatic mode printing based on minor feeding is performed by a lower-edge unit 41*b*3.

As best shown in FIG. 3, printing head 28 has a plurality of nozzles n provided in a row for each color, and an actuator circuit 90 that operates a piezo-element PE that is provided on each nozzle n. Actuator circuit 90 is part of head drive circuit 52 (see FIG. 4), and performs on/off control of drive signals given from a drive signal generating circuit (not illustrated) within head drive circuit 52. Specifically, actuator circuit 90 latches data that shows "on" (i.e., when ink is ejected) or "off" (i.e., when ink is not ejected) for each nozzle according to the print signal PS supplied from computer 88, and the drive signal is applied to the piezo-element PE only for the nozzles that are on.

FIG. 3 illustrates the arrangement of nozzles provided on printing head 28. The conventional prior art inkjet printer 20 is a printing apparatus that performs printing using four colors of ink: black (K), cyan (C), magenta (M), and yellow (Y). Five nozzles each are provided for cyan (C), magenta (M), and yellow (Y), and fifteen nozzles are provided for black (K). The cyan nozzle group, magenta nozzle group, and yellow nozzle group are arranged in sequence in the direction of sub-scanning. The black nozzle group is disposed in the area for accommodating the nozzles of the cyan nozzle group, single chromatic nozzle group, and yellow nozzle group in the direction of sub-scanning. Nozzles #1 through #5 of cyan (C), magenta (M) and yellow (Y) correlate to a "single chromatic nozzle group". Nozzles #1 through #15 for black (K) correlate to an "achromatic nozzle group".

Provided in actuator circuit 90 are actuator chips 91 to 93 which drive black nozzle row K, actuator chip 94 which drives cyan nozzle row C, actuator chip 95 which drives magenta nozzle row M, and actuator chip 96 which drives yellow nozzle row Y. In use, printing head 28 slides back and forth along sliding axis 34 in the direction of arrow MS (in FIG. 3) by carriage motor 24. Printing paper P is sent in the arrow SS direction in relation to printing head 28 by paper feed motor 22.

Conventional inkjet printers, such as the printer 20 described above, contain moving assemblies, thus often causing the printing process to be relatively slow, as well as requiring frequent calibration and being prone to misalignments, mechanical damage and other malfunctions.

Thus, a pagewidth inkjet printer solving the aforementioned problems is desired.

SUMMARY OF THE INVENTION

The pagewidth inkjet printer provides for simultaneous printing across a horizontal portion of a sheet of paper, as opposed to the horizontal scanning of a conventional inkjet printer. The pagewidth inkjet printer includes a platen that incrementally translates a page of paper and a controller for selectively driving rotation of the platen, as is conventionally known. A housing is mounted adjacent to the platen and is fixed with respect thereto.

A plurality of print heads are mounted within the housing and are at least partially housed therein. Each print head has a plurality of nozzles for selectively ejecting ink, and each nozzle of each print head is adapted for ejecting a distinct color of ink. Each print head preferably has five nozzles formed therein, and the five nozzles may correspond to black ink, cyan ink, yellow ink, blue ink and pink ink, for example.

The plurality of nozzles of each print head are aligned in a direction parallel to the direction of translation of the page of paper. The plurality of print heads are arrayed and aligned linearly along a direction orthogonal to the direction of translation of the page of paper. Preferably, the plurality of print heads span the entire width of the page or sheet of paper. A controller for selectively ejecting ink from selected ones of the plurality of nozzles is further provided, as is conventionally known.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
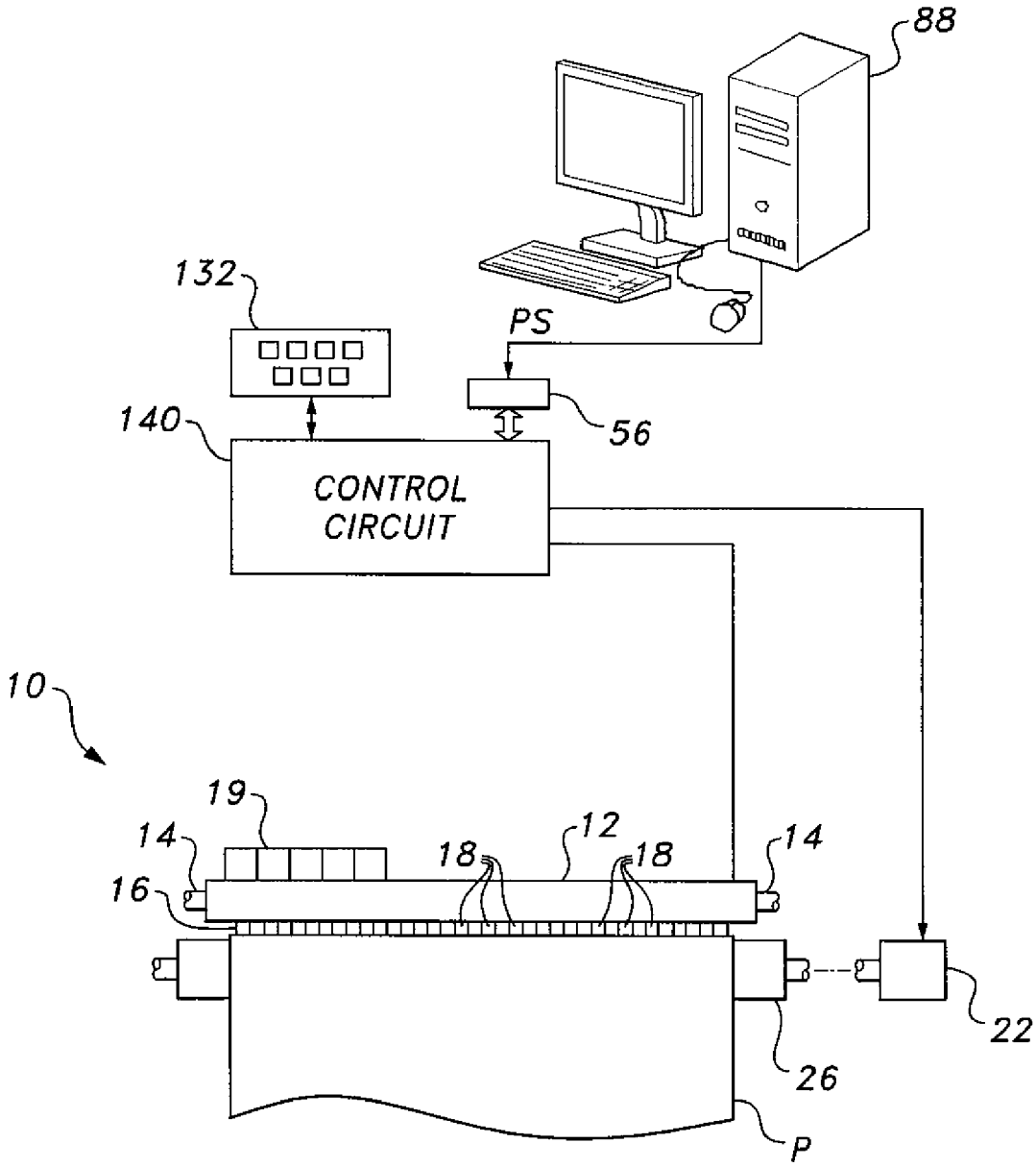
FIG. 1 is a diagrammatic overview of a pagewidth inkjet printer according to the present invention.

Referring to FIG. 1, the pagewidth inkjet printer 10 has a stationary array 16 of print heads 18. In FIG. 1, pagewidth inkjet printer 20 is shown as being in communication with a computer 88 in communication with a control circuit 140, which utilizes a control pad 132 or the like, similar to printer 20 of FIG. 2. It should be understood that the pagewidth inkjet printer 10 may be used in combination with any suitable type of computer or other system for generating data to be printed on paper, and may include any suitable type of user interface. The elements of FIG. 1 are shown for illustrative purposes only.

Figure 2:
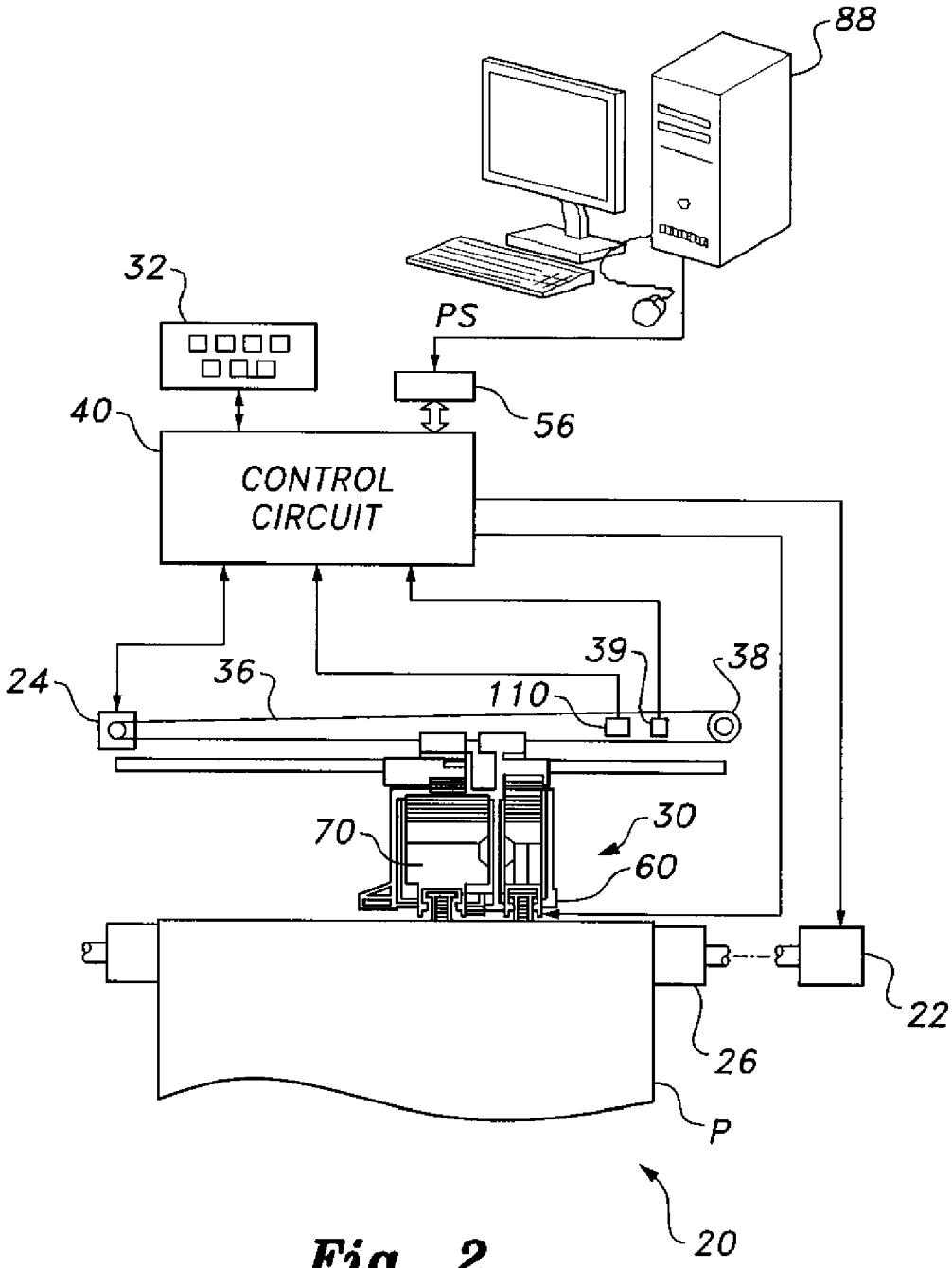
Fig. 2 PRIOR ART
FIG. 2 is a diagrammatic overview of a conventional inkjet printer of the prior art.

Unlike the printer 20 of FIG. 2, which utilizes a print head that is movable on a rail with respect to the platen 26, the pagewidth inkjet printer 10 includes a print head array 16 that spans the entire width of the sheet or page of paper P, and that remains stationary with respect to the paper P and the platen 26. The print head array 16 is at least partially contained within a housing 12, which may be mounted adjacent platen the 26 by any suitable supports or mounts (it should be understood that supports 14 are shown for exemplary purposes only).

Figure 5:
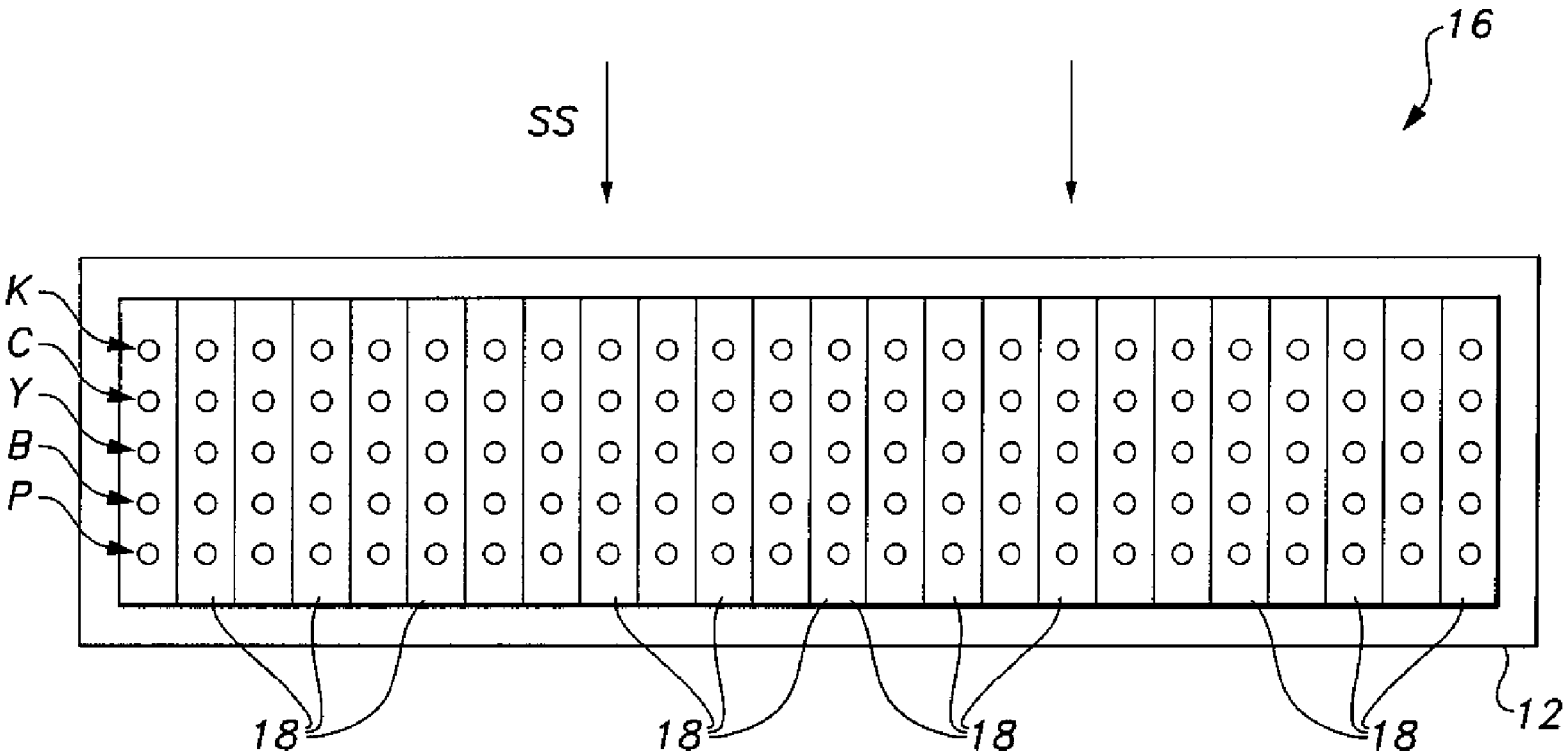
FIG. 5 is a plan view of a print head array of the pagewidth inkjet printer according to the present invention.

As best shown in FIG. 5, the print head array 16 includes a plurality of individual print heads 18. Each print head 18 has five separate nozzles for ejecting ink, the five nozzles being aligned in a direction parallel to the direction of the paper P's movement (indicated by directional arrow SS). The print heads 18 are arrayed linearly along a direction orthogonal to the direction of the paper P's path; i.e., the print heads are placed next to each other to span the entire width of the page P. In FIG. 5, twenty-four such print heads 18 are shown in the print head array 16, although it should be understood that any desired number may be utilized. An increase in the number of print heads 18 corresponds to an increase in printing resolution.

Figure 3:
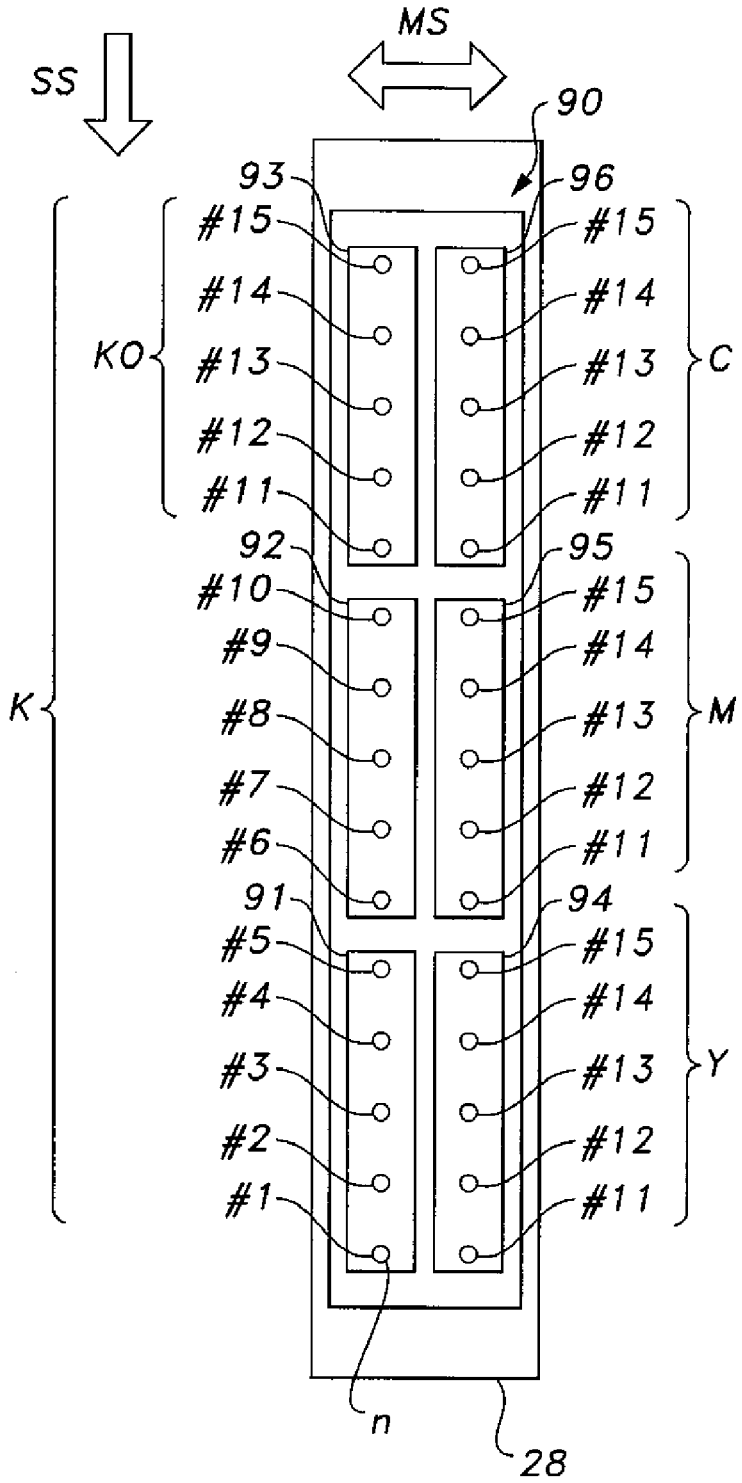
Fig. 3 PRIOR ART
FIG. 3 illustrates conventional print head arrangement in the prior art inkjet printer of FIG. 2.
Figure 4:
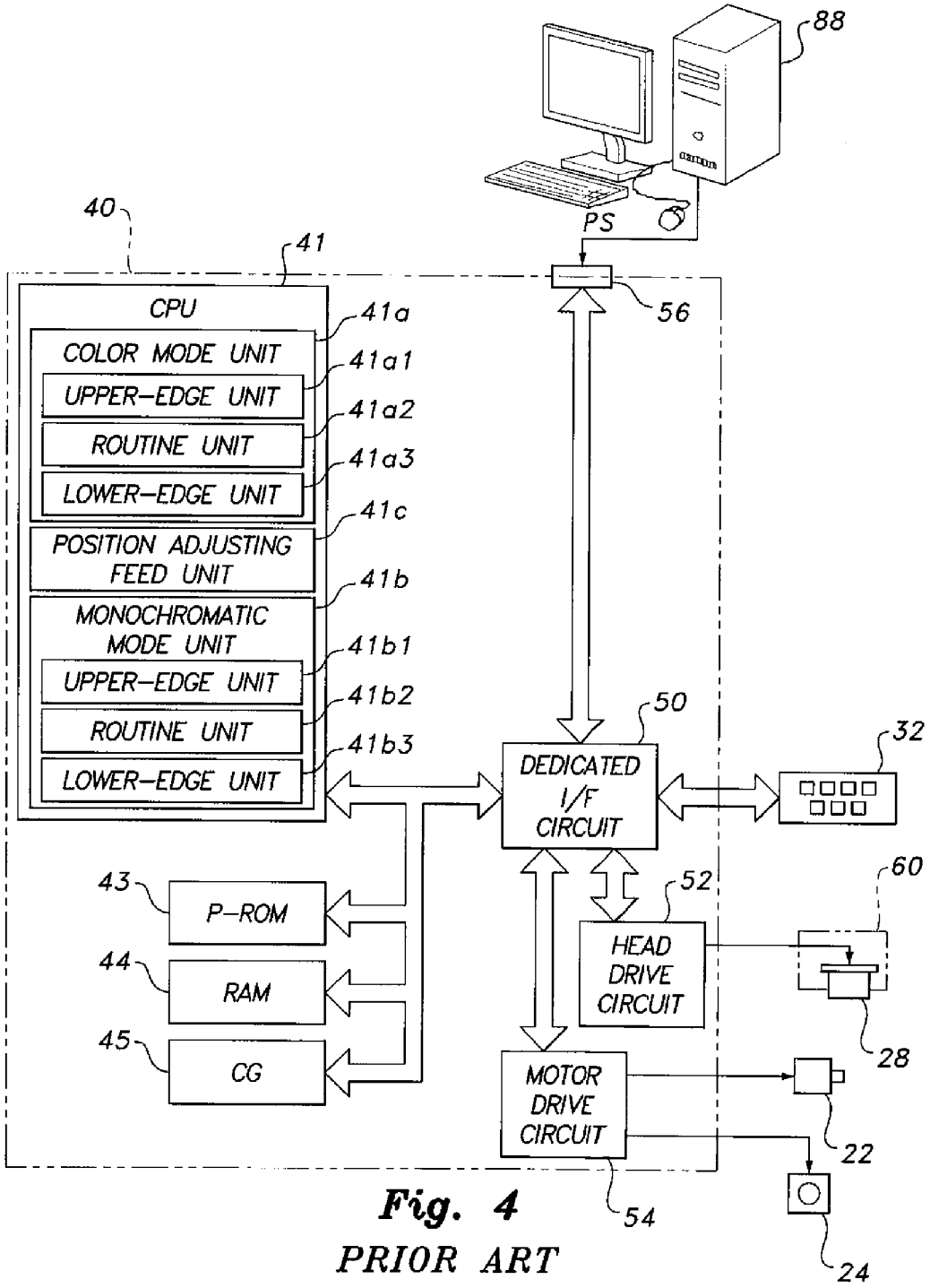
Fig. 4 PRIOR ART
FIG. 4 is a block diagram illustrating control circuits for the prior art inkjet printer of FIG. 2.

The construction of each individual print head 18, including the nozzles associated therewith, as well as the control elements for turning each nozzle on or off and for controlling the paper's movement, are similar to that of a conventional inkjet print head, such as those shown in U.S. Pat. Nos. 6,629,744 or in 6,443,555, each of which is hereby incorporated by reference in its entirety. As opposed to the ink colors provided in the inkjet printer of FIGS. 2 and 3, each print head 18 has a nozzle K for ejecting black ink, a nozzle C for ejecting cyan ink, a nozzle Y for ejecting yellow ink, a nozzle B for ejecting blue ink, and a nozzle P for ejecting pink ink. As is well known in the art, each print head 18 is in fluid communication with a feeding ink tank or reservoir, such as reservoir 19, diagrammatically shown in FIG. 1. Although shown as having five separate chambers for five separate ink colors, it should be understood that the reservoir 19 is shown for exemplary purposes, and any suitable number of chambers or any suitable number of separate reservoirs or tanks may be utilized, depending upon the number of different inks utilized.

The housing 12 and the print head array 16 are mounted above the platen 26 in a fixed and permanent manner, so that print head array 16 remains stationary with respect to platen 26. In the alternative embodiment of FIG. 6, the print head array is divided into a first row 13 and a second row 15, each extending linearly in the direction orthogonal to direction SS. Preferably, as shown, the individual print heads 18 alternate between positioning in the first row and the second row and are staggered. The arrangement of print heads 18 in FIG. 6 ensures that there are no gaps in printed images due to the low nozzle packing densities permitted by standard inkjet printers, and further allows for the production of larger print heads.

As opposed to a conventional inkjet printer, where a moving print head and color-cartridge assembly slides across the page from side to side (i.e., from left to right with respect to the page), thus printing only a portion of a single horizontal strip at a time as the page incrementally moves forward, the pagewidth inkjet printer 10 allows for printing along a full horizontal strip all at once (i.e., each individual print head 18 may operate at the same time as the other print heads 18 in array 16, thus allowing for printing along the entire width of the page P simultaneously), thus greatly enhancing speed of printing as compared to a conventional inkjet printer. A control circuit is operable to selectively turn the nozzles of each print head 18 on and off so that each stationary print head 18 prints only the portion of a horizontal line of print corresponding to the horizontal portion of the page that passes below the print head 18, the print heads 18 printing simultaneously to print each portion of the horizontal line of print simultaneously.

Figure 6:
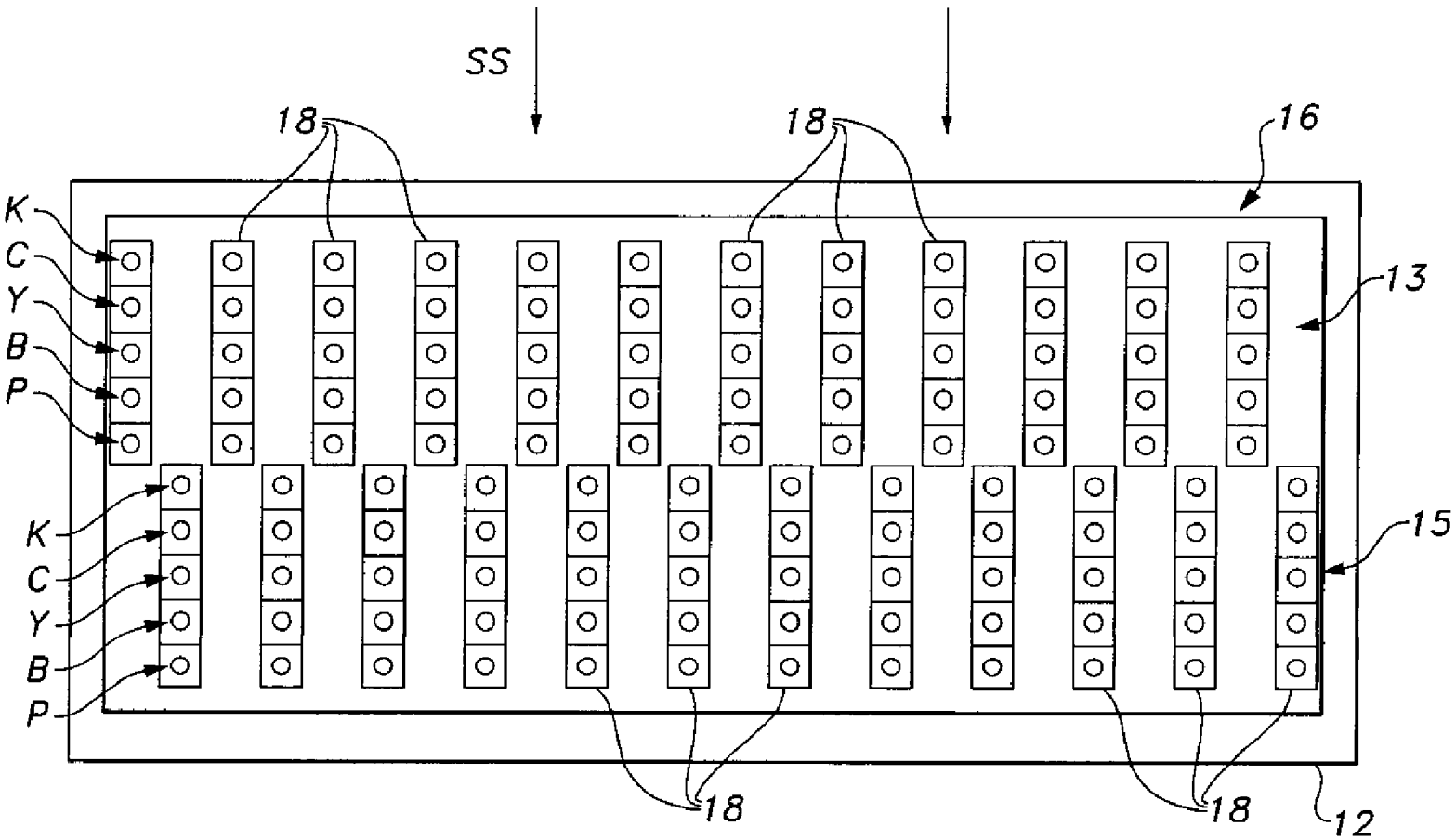
FIG. 6 is a plan view of an alternative embodiment of a print head array of the pagewidth inkjet printer according to the present invention.

Although FIGS. 5 and 6 illustrate each print head 18 having nozzles K, C, Y, B and P, it should be understood that any desired number of nozzles may be used, for example, to increase the number of colors of ink that may be ejected therefrom, and to provide any desired combination of colors. Cyan, yellow, blue and pink have been used herein for exemplary purposes only.

It is to be understood that the present invention is not limited to the embodiment described above, but encompasses any and all embodiments within the scope of the following claims.

I claim:

1. A pagewidth inkjet printer, comprising:

a platen operable to incrementally translate a page of paper;

means for selectively driving rotation of the platen;

a housing mounted adjacent to the platen and fixed with respect thereto;

a plurality of print heads mounted within the housing and at least partially housed therein, each of the print heads having a plurality of nozzles for selectively ejecting ink, each of the nozzles of each of the print heads being adapted for ejecting a distinct color of ink, the plurality of nozzles of each the print head being linearly aligned in a direction parallel to a direction of translation of the page of paper, the plurality of print heads being arrayed and aligned linearly and orthogonal to the direction of translation of the page of paper, wherein each said print head extends along a direction parallel to the direction of translation of the page of paper, each said print head being contiguous with adjacent ones of said print heads; and means for selectively ejecting ink from selected ones of the plurality of nozzles from each of the print heads simultaneously to print each portion of a horizontal line of print simultaneously.

2. The pagewidth inkjet printer as recited in claim 1, wherein the plurality of print heads span an entire width of the page of paper.

3. The pagewidth inkjet printer as recited in claim 2, wherein each said print head has five nozzles.

4. The pagewidth inkjet printer as recited in claim 3, wherein the five nozzles of each said print head are adapted for the selective ejection of black ink, cyan ink, yellow ink, blue ink and pink ink, respectively.

5. The pagewidth inkjet printer as recited in claim 4, wherein the plurality of nozzles of each said print head are arrayed and aligned linearly and orthogonal to the direction of translation of the page of paper with respect to the plurality of nozzles of the other ones of said plurality of print heads.

6. A printing unit for a pagewidth inkjet printer, comprising:

a housing adapted for fixed mounting adjacent a platen;

a plurality of print heads mounted within the housing and at least partially housed therein, each of the print heads having a plurality of nozzles for selectively ejecting ink, each of the nozzles of each of the print heads being adapted for ejecting a distinct color of ink, the plurality of nozzles of each of the print heads being linearly aligned in a direction orthogonal to an axis of the platen, the plurality of print heads being arrayed and aligned linearly parallel to the axis of the platen, wherein each said print head extends along a direction orthogonal to the axis of the platen, each said print head being contiguous with adjacent ones of said print heads; and means for selectively ejecting ink from selected ones of the plurality of nozzles from each of the print heads simultaneously to print each portion of a horizontal line of print simultaneously.

7. The printing unit for a pagewidth inkjet printer as recited in claim 6, wherein the plurality of print heads span an entire width of the page of paper.

8. The printing unit for a pagewidth inkjet printer as recited in claim 7, wherein each said print head has five nozzles.

9. The printing unit for a pagewidth inkjet printer as recited in claim 8, wherein the five nozzles of each said print head are adapted for the selective ejection of black ink, cyan ink, yellow ink, blue ink and pink ink, respectively.

10. The printing unit for a pagewidth inkjet printer as recited in claim 9, wherein the plurality of nozzles of each said print head are arrayed and aligned linearly and parallel to the axis of the platen with respect to the plurality of nozzles of the other ones of said plurality of print heads.

* * * * *